US007100709B2

(12) United States Patent
Bowe et al.

(10) Patent No.: US 7,100,709 B2
(45) Date of Patent: Sep. 5, 2006

(54) FEED TABLE PIVOT PIN CONSTRAINING DEVICE

(75) Inventors: James M. Bowe, McKinney, TX (US); Larry W. McClure, Sherman, TX (US)

(73) Assignee: Metso Minerals Industries, Inc., Milwaukee, WI (US)

( * ) Notice: Subject to any disclaimer, the term of this patent is extended or adjusted under 35 U.S.C. 154(b) by 293 days.

(21) Appl. No.: 10/657,433

(22) Filed: Sep. 8, 2003

(65) Prior Publication Data

US 2005/0051364 A1 Mar. 10, 2005

(51) Int. Cl.
*E21B 3/02* (2006.01)
*E21B 15/04* (2006.01)

(52) U.S. Cl. ..... 175/113; 175/162; 175/203; 173/192

(58) Field of Classification Search ..... 173/44, 173/192, 190, 28; 175/62, 203, 162, 220, 175/113

See application file for complete search history.

(56) References Cited

U.S. PATENT DOCUMENTS 2,123,897 A * 7/1938 Holmes ..... 173/145
2,334,312 A * 11/1943 Caldwell ..... 173/164
2,792,198 A * 5/1957 Braun ..... 175/5
2,799,249 A * 7/1957 Lear ..... 91/44
2,815,191 A * 12/1957 Beltz ..... 173/38
2,908,482 A 10/1959 Curtis et al.
3,021,099 A * 2/1962 Samhammer et al. ..... 248/654
3,252,527 A * 5/1966 Alexander et al. ..... 173/41
3,322,378 A 5/1967 Thompson
3,565,184 A * 2/1971 Gustafsson et al. ..... 173/28
3,664,436 A * 5/1972 Beagan, Jr. ..... 173/193
3,809,344 A * 5/1974 Kolderup et al. ..... 173/185
3,896,887 A * 7/1975 Council ..... 173/193
3,965,628 A * 6/1976 Loftis ..... 52/115
4,088,289 A * 5/1978 Wood et al. ..... 248/647
4,099,579 A * 7/1978 Stormon ..... 173/4
4,719,978 A 1/1988 Klemm ..... 175/113
4,848,485 A * 7/1989 Piipponen et al. ..... 175/27
4,858,700 A 8/1989 Shafer
4,860,837 A 8/1989 Robert ..... 175/113
4,925,320 A 5/1990 Foster et al. ..... 384/42
5,000,271 A 3/1991 Uitto et al. ..... 173/39
5,226,488 A 7/1993 Lessard et al. ..... 175/61
5,413,186 A 5/1995 Campbell ..... 175/296
5,941,324 A 8/1999 Bennett ..... 175/85
5,996,710 A 12/1999 Jansson et al. ..... 175/52

(Continued)

FOREIGN PATENT DOCUMENTS

EP 1512831 A1 * 3/2005

*Primary Examiner*—Jennifer H. Gay
(74) *Attorney, Agent, or Firm*—Abelman, Frayne & Schwab

(57) ABSTRACT

A restraining arrangement for limiting the separation of a feed table having a pivot pin and a positioner block of a mobile track drill. The restraining arrangement includes a first constraint device positioned on the positioner block and a second constraint device secured to the feed table. The first constraint device, consisting of a bushing having a pair of extending ears, is retained within a pair of female constraint members each having a recessed groove. The recessed groove formed in each of the pair of female constraint members is sized to receive the extending ears to allow the bushing and the female constraint members to rotate relative to each other while limiting the separation between the feed table and the positioner block along the rotational axis of the pivot pin.

30 Claims, 6 Drawing Sheets

U.S. PATENT DOCUMENTS 6,009,957 A 1/2000 Esko et al. ..... 173/4
6,357,537 B1 3/2002 Runquist et al. ..... 175/62
6,604,586 B1 * 8/2003 Tremblay ..... 175/171
6,889,779 B1 * 5/2005 Skarlupka et al. ..... 173/184
2005/0098364 A1 * 5/2005 Johnson et al. ..... 180/65.1

* cited by examiner

FEED TABLE PIVOT PIN CONSTRAINING DEVICE

BACKGROUND OF THE INVENTION

The present invention generally relates to a mobile track drill. More specifically, the present invention relates to a mechanical device that restricts the relative movement between the feed table and the positioning elements of drilling equipment upon mechanical failure.

In presently available mobile track drills, a drill track is used to guide the movement of a drill along a longitudinal axis. The drill track, in turn, is mounted to a feed table that serves as the point of connection to the articulated drilling boom of the movable track drill. Specifically, the feed table includes a pivot pin that is received and retained within a positioner block mounted to the drilling boom. The positioner block, in turn, is coupled to a hydraulic cylinder to control the position of the drill track to orient the drill track in the desired direction.

The pivot pin contained on the feed table allows the feed table and the attached drill track to rotate relative to the positioner block to further control the position of the drill track as desired. In present available mobile track drills, the feed table is manufactured such that the pivot pin is inserted into the positioner block and a retaining cap is attached to the pivot pin by a series of bolts to retain the pivot pin within the positioner block. The axial alignment and integrity of the feed table/positioner block joint is assured only by the material integrity of the pivot pin, the retaining cap and the connecting bolts.

During operation of the mobile track drill, if the drill track contacts the ground or an overhead obstacle while the mobile track drill is being moved, only the material integrity of the retaining cap, the pivot pin and the connecting bolts prevents separation of the drill track, feed table and drill from the drill boom. Any failure in these components could result in the unrestrained movement of the feed table and drill track away from the drill boom which, depending upon the direction of such relative movement, could result an undesirable and possibly unsafe situation.

Therefore, a need exists for a constraining device that further limits the ability of the feed table and drill track to separate from the positioner block mounted to the drill boom. Further, a need exists for a constraining device that allows the feed table to freely pivot relative to the positioner block while restricting the uncontrolled separation of the feed table from the positioner block.

SUMMARY OF THE INVENTION

The present invention is a restraining arrangement that limits the possible separation between the drill boom and drill assembly of a mobile track drill. The restraining arrangement acts to prevent the unrestrained movement of the drill assembly, including both the drill track and drill, upon a structural failure in the connecting components between the drill assembly and the drill boom.

The restraining arrangement of the present invention includes a first constraint device that is secured to the positioner block mounted to the drill boom of the mobile track drill. The first constraint device includes a bushing that is press fit into the positioner block. The bushing includes a cylindrical body having a generally open interior and an upper rim connected to the cylindrical body. The generally open interior of the bushing is sized to receive a pivot pin formed as part of the drilling assembly. The upper rim of the bushing includes a pair of extended ears that are spaced from each other along the outer circumference of the upper rim.

The restraining arrangement includes a second constraint device that is secured to the feed table of the drilling assembly. The feed table, in turn, is securely connected to the drill track and provides the point of rotatable connection between the drill track and the positioner block. Specifically, the feed table includes a pivot pin that extends from the feed table and is received within the positioner block. Specifically, the pivot pin is received within the open interior of the bushing secured within the positioner block.

The second constraint device includes a pair of female constraint members that are mounted to the lower wall of the feed table. The female constraint members are spaced from the pivot pin and each include a recessed groove. The recessed groove formed on each of the female constraint members is sized to receive the extended ears formed on the bushing such that the ears of the bushing are freely rotatable within the recessed grooves.

The female constraining members are spaced from each other to define a pair of insertion gaps. The recessed groove formed in each of the female constraint members is interrupted along the insertion gap. The insertion gap allows the upper rim, and more specifically the extended ears, of the bushing to be inserted within the female constraint members.

The second constraint device further includes a pair of retaining caps that are mountable between the female constraint members. Specifically, the retaining caps are mountable to the female constraint members such that the retainer caps extend across the insertion gaps to secure the bushing between the pair of female constraint members. Each of the retaining caps includes a recessed groove similar to the recessed groove formed in the female constraint members, such that when the retaining caps are mounted to the female constraint members, the recessed groove is continuous around the pivot pin. The continuous recessed groove allows the extended ears of the bushing to rotate freely while preventing separation between the bushing and the female constraint members.

The restraining arrangement of the present invention thus allows unrestricted rotation of the feed table relative to the positioner block while limiting the separation between the feed table and the positioner block should a structural failure occur in either the retaining cap, the pivot pin or the connectors used to secure the pivot pin within the positioner block. The restraining arrangement of the present invention thus provides an additional level of security to restrict the uncontrolled movement of the drilling assembly relative to the drill boom of the track drill upon failure of structural components within the track drill.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
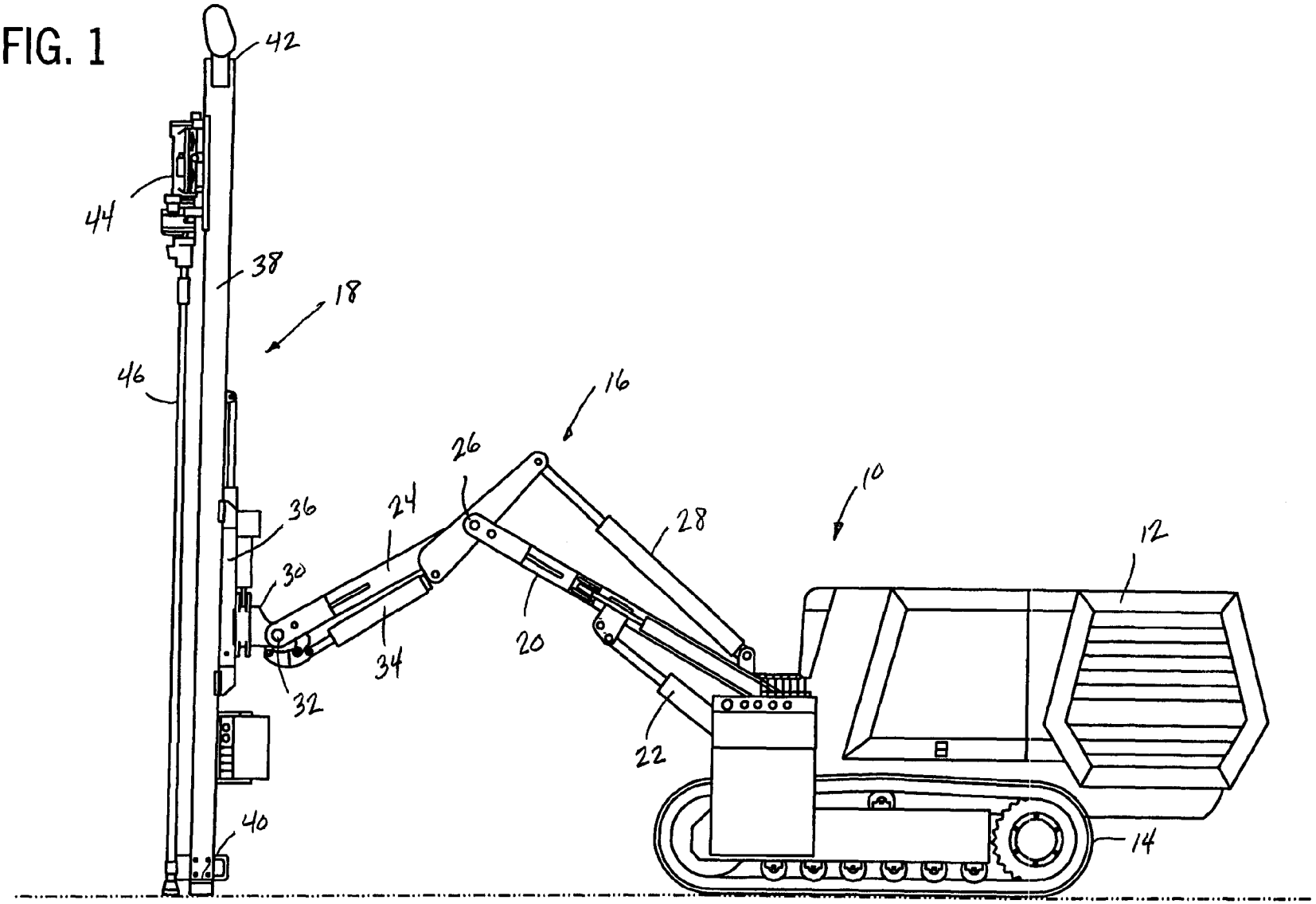
FIG. 1 is a side schematic view of a self-contained, mobile track drill incorporating the features of the present invention.

Referring first to FIG. 1, there shown is a mobile track drill 10 that incorporates the features of the present invention. In the preferred embodiment of the invention, the mobile track drill 10 is a HYDRA-TRAC hydraulic track drill available from Reedrill of Sherman, Tex.

The mobile track drill 10 includes an engine 12 supported by a pair of track drives 14. The track drives 14 are entrained about a series of wheels such that the mobile track drill 10 can be moved to various locations for use. The mobile track drill 10 includes a multi-section drill boom 16 that is used to support and position a drill assembly 18. The orientation of the drill assembly 18 can be controlled through various hydraulic cylinders as will be discussed in greater detail below.

As can be seen in FIG. 1, the drill boom 16 includes a first section 20 whose angular position is controlled by a first drive cylinder 22. The first section 20 is rotatably connected to a second section 24 about a pivot point 26. The movement of the second section 24 relative to the first section 20 is controlled by a second hydraulic drive cylinder 28. The extension and retraction of the second drive cylinder 28 controls the rotation of the second section 24 relative to the first section 20.

The second section 24, in turn, is connected to a positioner block 30. The positioner block 30 is rotatable about a pivot point 32 and such rotation is controlled by a third drive cylinder 34. The extension and retraction of the third drive cylinder 34 controls the orientation of the positioner block 30, as can be understood.

The positioner block 30, in turn, is coupled to a feed table 36. The feed table 36, as will be described in greater detail below, is pivotable within the positioner block 30 such that the feed table 36 can rotate relative to the positioner block 30.

The feed table 36 is securely mounted to a drill track 38 that extends from a first end 40 to a second end 42. In the embodiment of the invention shown, the drill track 38 has a length of approximately thirty feet, although other lengths are contemplated as being within the scope of the present invention. A rock drill 44 is movable along the length of the drill track 38 and includes a drill bit 46. As is conventional, the rock drill rotates the drill bit 46 to drill a hole as the rock drill 44 moves downward along the longitudinal axis of the drill track 38. The operation of the mobile track drill 10 is conventional and thus will not be described in greater detail in the present application.

Figure 2:
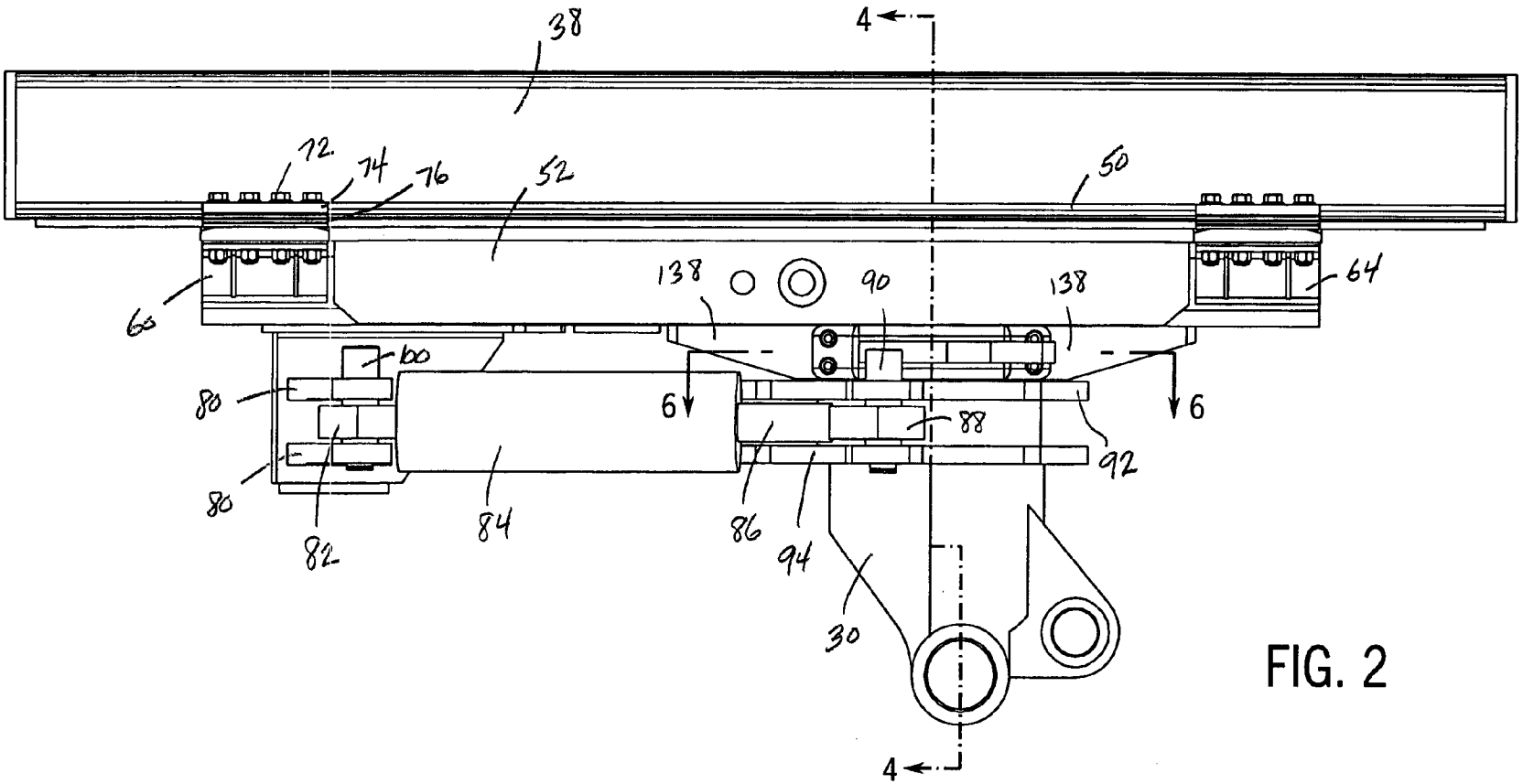
FIG. 2 is a side view illustrating the interconnection between the feed table and the drill positioner block of the track drill incorporating the restraining arrangement of the present invention.
Figure 3:
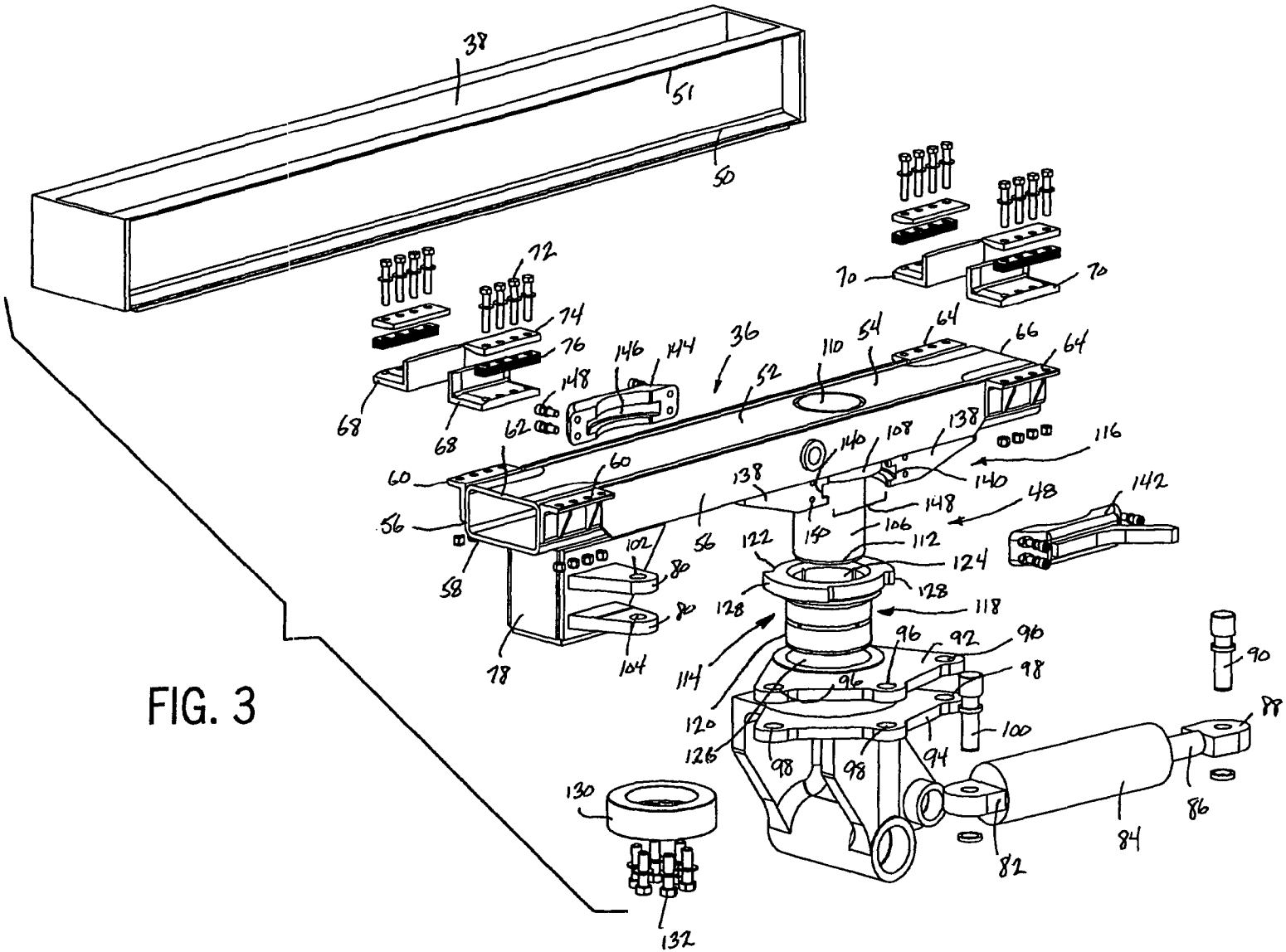
FIG. 3 is an exploded view of the arrangement shown in FIG. 2.

Referring now to FIGS. 2 and 3, thereshown is the physical connection between the drill track 38, feed table 36 and positioner block 30, including the restraining arrangement of the present arrangement.

In FIG. 3, the drill track 38 is shown in a shortened condition for illustrative purposes only. It should be understood that the drill track 38 has a length substantially longer than shown. The drill track 38 includes a lower lip 50 and an upper lip 51 formed on each of its opposite sides. The upper lip 51 serves as the point of attachment for the rock drill 44, shown in FIG. 1, and allows the rock drill to move along the length of the drill track 38. The lower lip 50 serves as a secure point of attachment for the support beam 52 of the feed table 36. The support beam 52 has a generally rectangular cross-section that includes an upper, attachment wall 54, a pair of sidewalls 56 and a lower support wall 58. The support beam 52 includes a pair of mounting brackets 60 positioned at its first end 62 and a corresponding pair of mounting brackets 64 positioned near its second end 66. Each of the mounting brackets 60, 64 are preferably welded to the support beam 52.

The support beam 52 is secured to the drill track 38 by a first pair of brackets 68 and a second pair of brackets 70. The brackets 68 and 70 interact with the brackets 60 and 64 to hold the support beam 52 in contact with the lower lip 50 of the drill track 38. A series of cap screws 72 pass through a wear pad 74 and a shim 76 to secure the support beam 52 to the drill track 38, as best shown in FIG. 2.

Referring back to FIG. 3, the feed table 36 includes a weldment 78 attached to the lower support wall 58 beneath its first end 62. The weldment 78 includes a pair of extending tabs 80 that receive a first end 82 of the rotational drive cylinder 84. The drive cylinder 84 includes a cylinder rod 86 having an end 88 that receives a pin 90. The second end 88 of the cylinder 84 is fixed between an upper plate 92 and a lower plate 94 of the positioner block 30. Specifically, the pin 90 passes through one set of the three sets of aligned holes 96 and 98. The three sets of aligned holes 96,98 can be used to adjust the stroke length of the cylinder 84 and control the degree of rotation of the feed table 36 relative to the positioner block 30. Pin 100 passes through the aligned holes 102 and 104 of the extending tabs 80 to hold the first end 82 between the extending tabs 80. Thus, the extension and retraction of the drive cylinder 84 controls the rotational movement of the feed table 36 relative to the positioner block 30, as will be described in much greater detail below.

Figure 4:
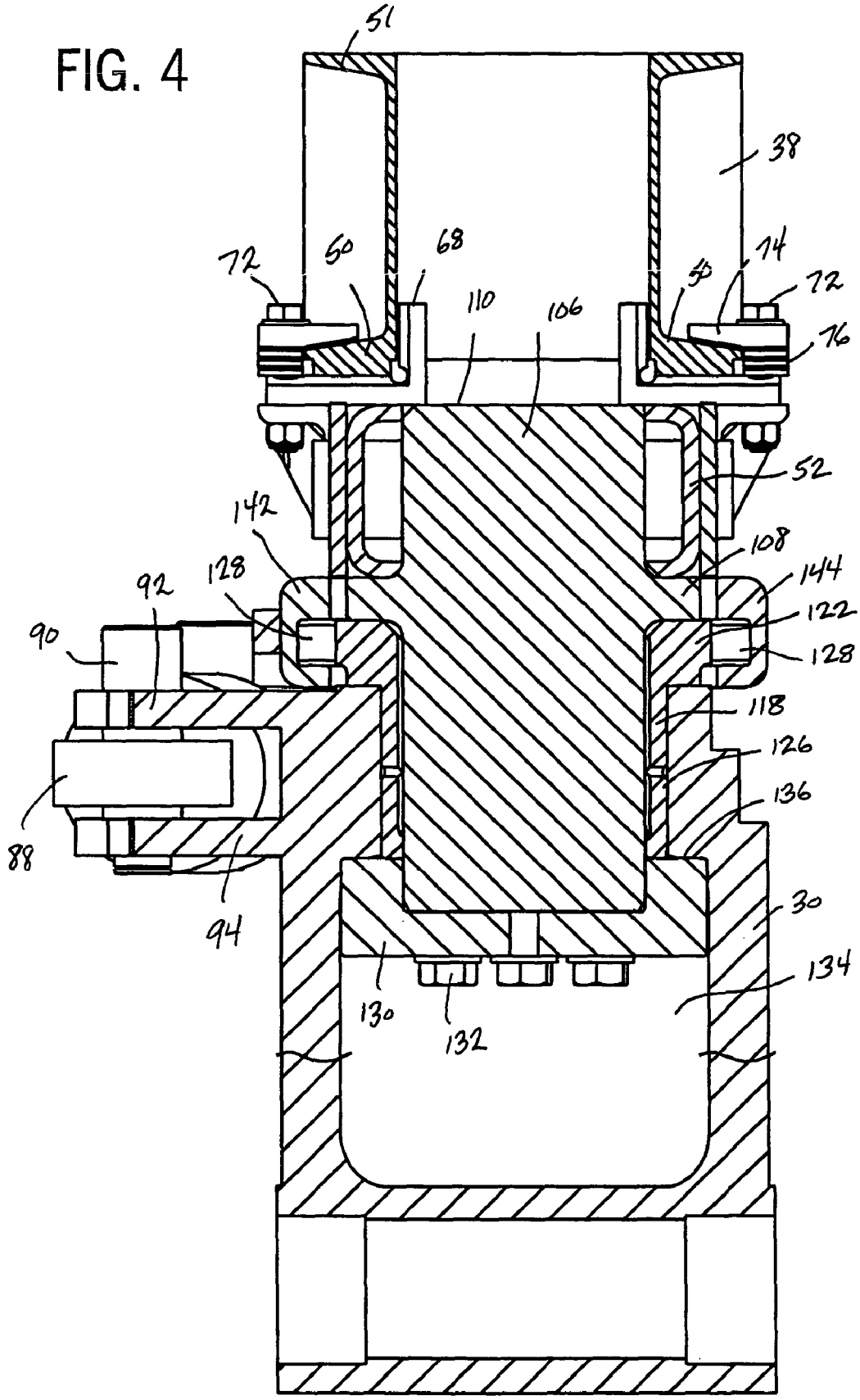
FIG. 4 is a section view taken along line 4—4 of FIG. 2.

Referring back to FIG. 3, the feed table 36 includes a pivot pin 106 that extends downward beneath the support wall 58 of the support beam 52. The pivot pin 106 is generally cylindrical in shape and includes an expanded diameter shoulder portion 108. As can be seen in FIGS. 3 and 4, the pivot pin 106 extends through the support beam 52 such that the top surface 110 of the pivot pin 106 is generally flush with the upper attachment wall 54. The opposite, second end 112 of the pivot pin 106 protrudes beneath the lower support wall 58 approximately eight inches.

Referring back to FIG. 3, in accordance with the present invention, a restraining arrangement 48 is positioned between the feed table 36 and the positioner block 30 to limit the possible separation of the feed table 36 from the positioner block 30. Specifically, the restraining arrangement 48 includes a first constraint device 114 secured to the positioner block 30 and a second constraint device 116 secured to the feed table 36. The interaction between the first and second constraint devices allows for rotation of the feed table 36 relative to the positioner block 30 while preventing the movement of the feed table 36 away from the positioner block 30.

In the preferred embodiment of the invention illustrated, the first constraint device 114 is a bushing 118 having a cylindrical lower body 120 and an upper rim 122. Preferably, the cylindrical body 120 and the upper rim 122 are formed as a single component from a metallic material, such as high strenght steel. The cylindrical body 120 defines an open interior 124 having an inner diameter sized to receive the pivot pin 106 such that the pivot pin 106 is freely rotatable within the open interior 124.

As can be best be understood in FIG. 3, the cylindrical body 120 of the bushing 118 is received within a bore 126 formed in the positioner block 30. In the embodiment of the invention illustrated, the bushing 118 is press fit into the bore 126 under pressure such that the bushing 118 is held in place by friction and is prevented from rotating relative to the positioner block 30.

Referring back to FIG. 3, the upper rim 122 of the bushing 118 includes a pair of extended ears 128. The extended ears 128 protrude from the outer circumference of the upper rim 122 approximately ¾ inches and have a thickness of approximately one inch. Each of the ears 128 extend approximately 45° along the outer circumference of the upper rim 122 and are thus separated by gaps of approximately 90°.

When the pivot pin 106 is inserted into the bushing 118, a retaining cap 130 is attached to the bottom end 112 of the pivot pin 106 by a series of connectors 132, as best shown in FIG. 4. As can be seen in FIG. 4, the retaining cap 130 is received within a central opening 134 of the positioner block 30. The central opening 134 includes an upper shoulder 136. The shoulder 136 prevents the retaining cap 130 from being pulled out of the positioner block 30, as can be clearly understood in FIG. 4. The interaction between the retaining cap 130 and the pivot pin 106 thus prevents separation of the feed table 36 from the positioner block 30 while allowing the feed table 36 to rotate relative to the positioned block.

Referring back to FIG. 3, the second constraining device 116 includes a pair of female constraint members 138 mounted to the lower support wall 58 of the support beam 52. Each of the female constraint members 138 defines an arcuate recessed groove 140. The recessed groove 140 has a height approximately equal to the thickness of the upper rim 122 of the bushing 118 such that the ears 128 of the bushing 118 can be received within the recessed grooves 140. The recessed grooves 140 have a curvature to correspond to the ear 128 such that the ears 128 can move along the length of the recessed grooves 140 as the feed table 36 rotates relative to the positioner block 30.

Figure 5:
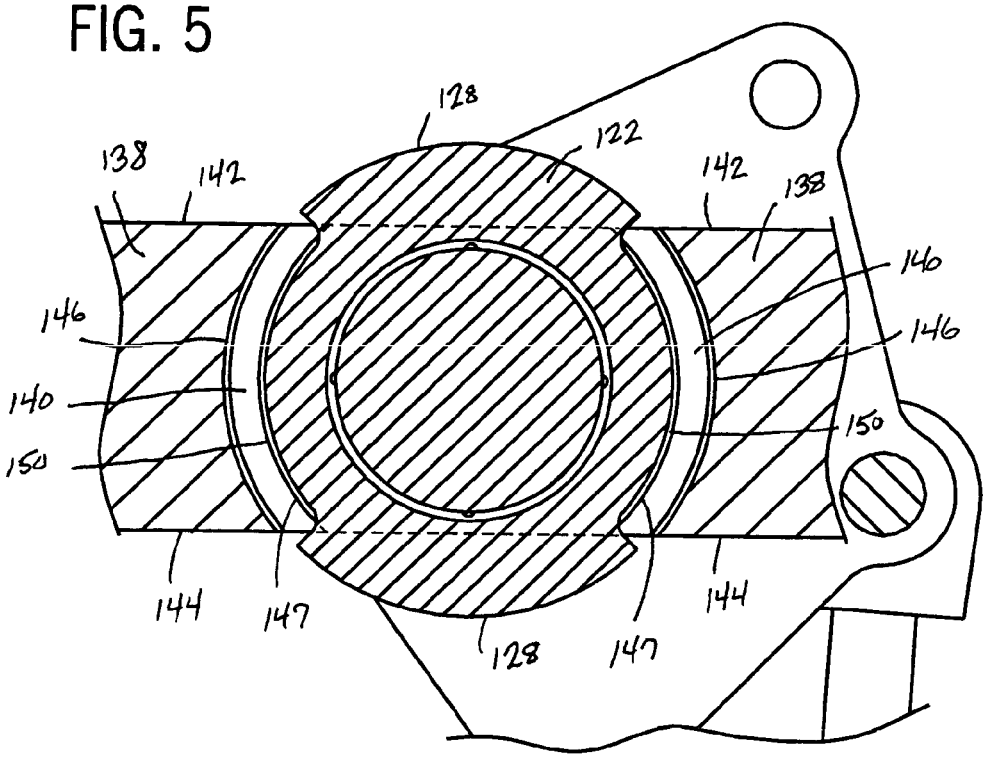
FIG. 5 is a section view taken along line 6—6 of FIG. 2 showing the insertion of the retaining bushing between the pair of female constraint members mounted to the feed table.

As can be seen in FIG. 5, each of the female constraint members 138 extends from a first face surface 142 to a second face surface 144. The recessed groove 140 is defined by a curved back wall 146 that is recessed from a curved outer wall 147 that defines an upper rim for the recessed groove 140. The groove 140 also includes a curved lower wall (not shown) similar to the outer wall 147 that defines a lower rim for the recessed groove 140. The curved back walls 146 of the opposed female constraint members 138 are spaced from each other to approximately the diameter of the upper rim 122 of the bushing 118 between the extending ears 128. The female constraint members 138 are spaced from each other to define a pair of insertion gaps 148 as shown in FIG. 3.

Figure 6:
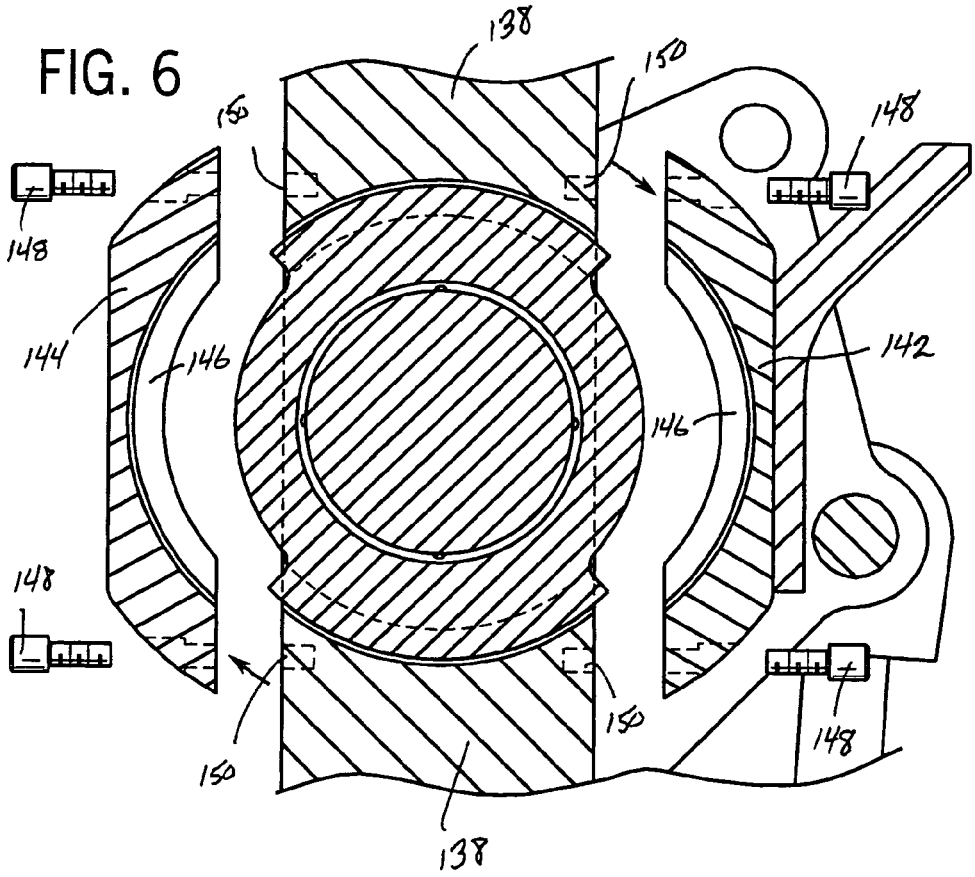
FIG. 6 is a view similar to FIG. 5 illustrating the rotation of the feed table and pair of female constraint members relative to the retaining bushing.
Figure 7:
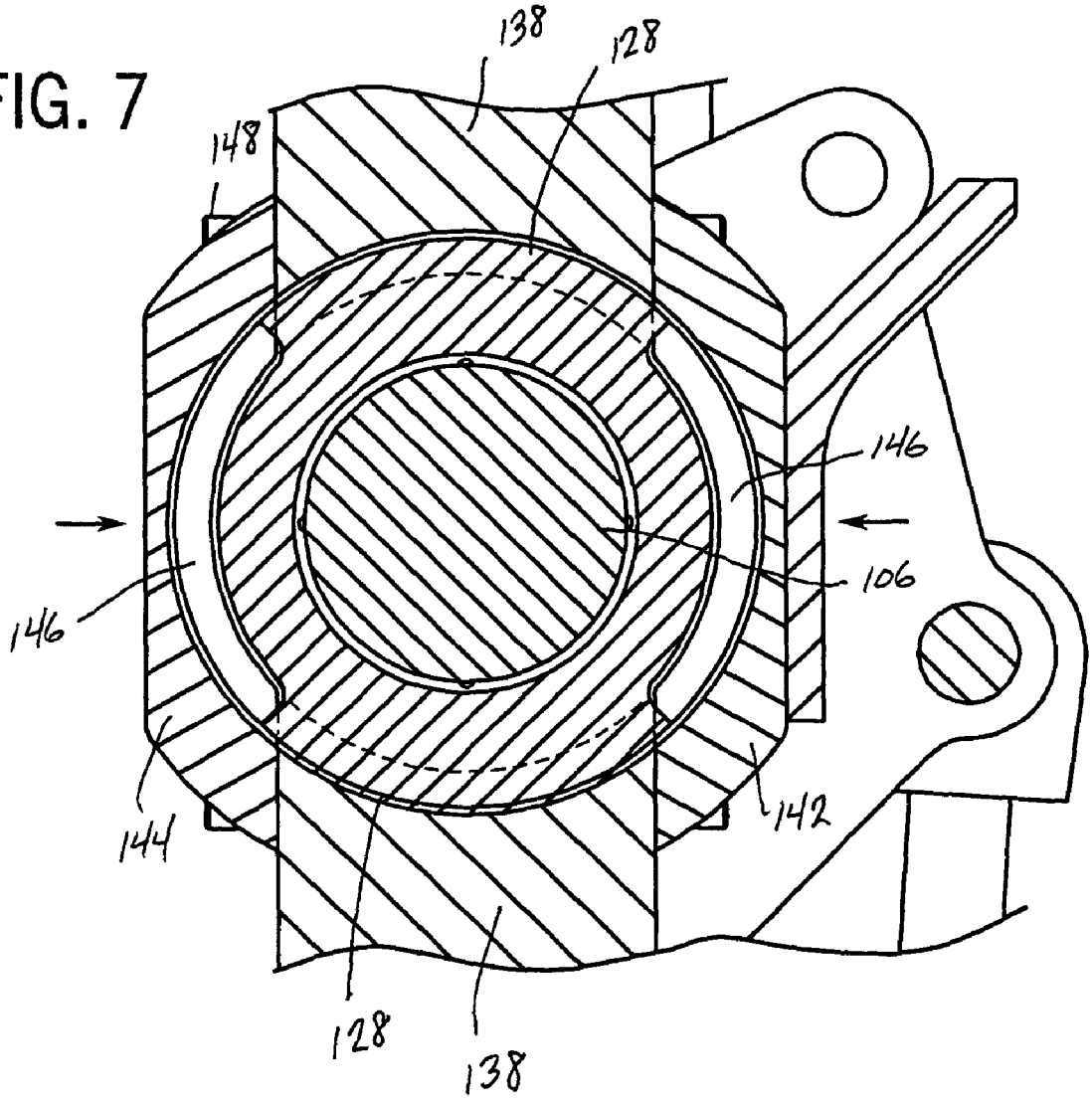
FIG. 7 is a view similar to FIG. 6 showing the pair of retainer caps secured to the female constraint members.

Referring now to FIGS. 5–7, the connection between the feed table 36 and the positioner block 30 will now be described. Initially, the feed table, including the pair of female constraint members 138, are rotated such that the female constraint members 138 are aligned with the portions 150 of the upper rim 122 between the pair of extending ears 128. In this position, the ears 128 are generally aligned with the insertion gaps extending between the pair of female constraint members 138.

Once the feed table is aligned in the position shown in FIG. 5, the feed table and the pair of female constraint members 138 are rotated 90° such that the ears 128 of the bushing are received within the recessed grooves 140 formed in the pair of female constraint members 138, as shown in FIGS. 5 and 6. As discussed previously, the height of the recessed grooves 140 formed in the female constraint members 138 is generally equal to the thickness of the ears 128 such that the ears are movable within the recessed grooves 140.

Referring back to FIG. 6, the restraining arrangement 48 of the present invention further includes a pair of retainer caps 142 and 144. As illustrated in FIG. 6, each of the retaining caps 142 and 144 includes a recessed groove 146 having the same depth and height as the recessed grooves 140 formed in each of the female constraint members 138.

Each of the retainer caps 142 and 144, is attachable to both of the female constraint members 138 by a series of connectors 148. The connectors 148 are received within holes 150 formed in the female constraint members 138. When the retainer caps 142 and 144 are connected to the female constraint members 138, the retainer caps 142, 144 complete a 360° to recessed groove.

Referring back to FIG. 7, thereshown are the retainer caps 142 and 144 mounted to the pair of female constraint members 138. In this condition, the ears 128 are completely enclosed within a recessed groove such that the bushing is prevented from separating from the pair of female constraint members 138 attached to the feed table.

Referring now to FIG. 4, it can be understood that should the pivot pin 106, the retaining cap 130 or the connectors 132 fail, the interaction between the bushing 118 and the second constraint device, including the pair of female constraint members 138 and retainer caps 142, 144 will limit the possible separation between the feed table 36 and the positioner block 30.

Various alternatives and embodiments are contemplated as being within the scope of the following claims particularly pointing out and distinctly claiming the subject matter regarded as the invention.

We claim:

1. A restraining arrangement for limiting the separation between a feed table having a pivot pin mounted thereto and a positioner block of a mobile track drill, the arrangement comprising:

a first constraint device secured to the positioner block; and a second constraint device fixedly secured to the feed table and configured to receive and retain the first constraint device, such that the second constraint device is rotatable relative to the first constraint device.

2. The restraining arrangement of claim 1 wherein the first constraint device includes a pair of extended ears and the second constraint device includes a recessed groove sized to receive the pair of extended ears.

3. The restraining arrangement of claim 2 wherein the first constraint device is stationarily mounted to the positioner block and the second constraint device is stationarily mounted to the feed table.

4. The restraining arrangement of claim 2 wherein the second constraint device includes a pair of female constraint members mounted to the feed table, each female constraint member defining a portion of the recessed groove.

5. The restraining arrangement of claim 4 wherein the pair of female constraint members are spaced from each other to define a pair of insertion gaps, wherein the recessed groove is discontinuous along the pair of insertion gaps.

6. The restraining arrangement of claim 5 wherein the length of each insertion gap is at least as long as the length of each of the extended ears formed on the first constraint device such that the extended ears can pass through the pair of insertion gaps.

7. The restraining arrangement of claim 5 further comprising a pair of retainer caps mountable to the pair of female constraint members, wherein each retainer cap is configured to extend across one of the insertion gaps between the female constraint members.

8. The restraining arrangement of claim 7 wherein each retainer cap includes a recessed groove such that when the retainer caps are mounted to the female constraint members, the recessed groove of the second constraint device is continuous.

9. The restraining arrangement of claim 2 wherein the first constraint device is a bushing received in the positioner block, the bushing having a central opening sized to receive the pivot pin of the feed table.

10. The restraining arrangement of claim 9 wherein the bushing includes an upper rim and a cylindrical body, the cylindrical body being sized to receive the pivot pin and the upper rim including the pair of extended ears.

11. The restraining arrangement of claim 10 wherein the bushing is formed from steel.

12. The restraining arrangement of claim 1, wherein said second constraint device circumscribes at least a portion of said pivot pin.

13. The restraining arrangement of claim 1, wherein the second constraint device is coaxially rotatable relative to the first constraint device.

14. A restraining arrangement for limiting the separation of a feed table having a pivot pin mounted thereto and a positioner block of a track drill, the arrangement comprising:

a male constraint member secured to the positioner block, the male constraint member including a pair of extended ears; and a pair of female constraint members fixedly mounted to the feed table, each female constraint member including a recessed groove sized to receive the extended ears formed on the male constraint member such that the female constraint member is rotatable relative to the male constraint member, wherein the interaction between the pair of female constraint members and the male constraint member prevents movement of the feed table away from the positioner block.

15. The restraining arrangement of claim 14 wherein the pair of female restraint members are spaced from each other to define a pair of insertion gaps.

16. The restraining arrangement of claim 15 wherein each of the insertion gaps have a length at least as great as the length of the extended ears formed on the male constraint member such that the male constraint member can be inserted into the female constraint members.

17. The restraining arrangement of claim 16 wherein the recessed groove formed by the pair of female constraint members is circular and the insertion gaps are diametrically opposite each other.

18. The restraining arrangement of claim 16 further comprising a pair of retainer caps each mountable between the pair of female constraint members such that each of the retainer caps extend across one of the insertion gaps.

19. The restraining arrangement of claim 18 wherein each of the retainer caps includes a recessed groove such that when the retainer caps are mounted to the female constraint members, the recessed groove is continuous.

20. The restraining arrangement of claim 14 wherein the male constraint member is a bushing received within the positioner block, the bushing having an upper rim and a cylindrical body, the cylindrical body being sized to receive the pivot pin and the upper rim including the pair of extended ears.

21. The restraining arrangement of claim 14, wherein the female constraint members are coaxially rotatable relative to the male constraint members.

22. A method of limiting the separation of a feed table having a pivot pin and a positioner block of a track drill, the method comprising the steps of:

mounting a male constraint member to the positioner block of the track drill, the male constraint member including at least a pair of extended ears;

fixedly mounting a pair of female constraint members to the feed table, each female constraint member including a recessed groove;

inserting the male constraint member into the female constraint member such that the extended ears of the male constraint member are received within the recessed grooves of the female constraint members, such that said female constraint member is rotatable relative to said male constraint member; and preventing the separation of the male constraint member from the female constraint member.

23. The method of claim 22 wherein the pair of female constraint members are separated from each other by an insertion gap, wherein each insertion gap has a length at least as great as the length of the pair of ears formed on the male constraint member such that the ears of the male constraint member can pass through the insertion gap.

24. The method of claim 23, further comprising the step of attaching a pair of retainer caps to the pair of female constraint members after the male constraint member is received within the pair of female constraint members, wherein the retainer caps prevent separation of the male constraint member from the female constraint members.

25. The method of claim 24 wherein each of the retainer caps includes a recessed groove sized to receive the extended ears formed on the male constraint member.

26. The method of claim 22 wherein the male constraint member is a bushing having an upper rim and a cylindrical body, the cylindrical body being sized to receive the pivot pin and the upper rim including the pair of extended ears.

27. The method of claim 22, wherein said step of inserting the male constraint member into the female constraint member further comprises inserting the male constraint member into the female constraint member such that said female constraint member is coaxially rotatable relative to said male constraint member.

28. A restraining arrangement for limiting the separation of a feed table having a pivot pin mounted thereto and a positioner block of a track drill, the arrangement comprising:

a male constraint member cooperating with a female constraint member to interconnect said feed table and positioner block, one of said constraint members being secured to the feed table and the other which being secured to the positioner block, said male constraint member extending along an axis and defining a plane of rotation for said female constraint member, said plane of rotation being positively angled with respect to said axis, such that said male member and said female member are constrained against separation in a direction transverse to the plane of rotation.

29. The restraining arrangement of claim 28, wherein said plane of rotation being positively angled comprises said plane of rotation being generally transverse with respect to said axis.

30. The restraining arrangement of claim 28 wherein said plane of rotation being positively angled comprises said plane of rotation being generally at an acute angle with respect to said axis.

* * * * *